United States Patent [19]

Mikolas

[11] 4,053,218

[45] Oct. 11, 1977

[54] DEVELOPMENT SYSTEM

[75] Inventor: Eugène A. Mikolas, Webster, N.Y.

[73] Assignee: Xerox Corporation, Stamford, Conn.

[21] Appl. No.: 630,836

[22] Filed: Nov. 10, 1975

[51] Int. Cl.[2] ..... G03G 15/09

[52] U.S. Cl. ..... 355/15; 118/652; 118/658

[58] Field of Search ..... 355/3 DD, 3 R, 15; 118/637, 658, 652, 657, 655; 427/18, 21; 15/1.5

[56] References Cited

U.S. PATENT DOCUMENTS

| | | | |
|---|---|---|---|
| 3,647,293 | 3/1972 | Queener | 355/15 |
| 3,894,513 | 7/1975 | Stanley et al. | 118/652 |

OTHER PUBLICATIONS

"Magnetic Brush Roll Cleaning", IBM Technical Disclosure Bulletin, Aug. 1972, p. 889.

*Primary Examiner*—L. T. Hix
*Assistant Examiner*—Kenneth C. Hutchison
*Attorney, Agent, or Firm*—J. J. Ralabate; C. A. Green; H. Fleischer

[57] ABSTRACT

An apparatus in which a powder pattern is formed on a surface. The apparatus applies particles to at least a portion of the surface as well as removing other extraneous particles therefrom.

14 Claims, 3 Drawing Figures

DEVELOPMENT SYSTEM

BACKGROUND OF THE INVENTION

This invention relates generally to an electrostatographic printing machine, and more particularly concerns an improved development system for use therein.

In the process of electrostatographic printing, an electrostatic latent charge pattern is recorded and reproduced in viewable form. The field of electrostatography includes electrophotographic and electrographic printing. Electrophotographic printing employs electromagnetic radiation to form the electrostatic latent image or charge pattern. Electrographic printing forms the latent image without the aid of electromagnetic radiation. In both of the foregoing processes, the latent image must be rendered viewable, i.e. developed with particles. Hereinafter electrophotographic printing will be discussed as an illustrative embodiment of the foregoing.

An electrophotographic printing machine employs a photoconductive member which is charged to a substantially uniform level to sensitize its surface. The charged portion of the photoconductive member is exposed to a light image of the original document being reproduced. As a consequence of the exposure, the charge is selectively dissipated in the irradiated areas in accordance with the light intensity reaching the surface. This records an electrostatic latent image on the photoconductive surface. The latent image recorded on the photoconductive surface is developed by bringing a developer mix into contact therewith.

Typically, a developer mix comprises dyed or colored thermoplastic powders, known in the art as toner particles, mixed with coarser carrier granules, i.e. ferromagnetic granules. The toner particles and carrier granules are selected such that the toner particles acquire the appropriate charge relative to the electrostatic latent image recorded on the photoconductive surface. As the developer mix is brought into contact with the latent image, the greater attractive force thereof causes the toner particles to transfer from the carrier granules thereto. This concept was originally disclosed by Carlson in U.S. Pat. No. 2,297,691 being further amplified and described by many related patents in the art. Heretofore, development systems have employed rotary impellers, fur brushes, bucket conveyors and magnetic brush systems to develop the electrostatic latent image. A magnetic brush system achieves a high degree of uniform toner deposition. Usually, a magnetic brush system includes a developer roll having a directional flux field for advancing the magnetizable developer mix into contact with the latent image.

Multi-color electrostatographic printing records a series of different electrostatic latent images on the photoconductive surface, each latent image corresponding to a particular color in the original document. In such a system, there is a need to develop each of the latent images, i.e. single color latent images, with toner particles complementary in color to the color of the filtered light image transmitted to the photoconductive surface.

In multi-color development systems, a plurality of developer units are required. The developer units each furnish the appropriately colored toner particles to the latent image. If all of the developer units are continuously in operation the resultant toner powder image will contain a mixture of colors from each of the developer units, i.e. the colors will be inter-mingled with one another. This will result in the toner powder image being mis-colored with the resultant multi-color copy lacking the appropriate color balance. Therefore, it is apparent that only one development system may be in operative communication with the latent image at a given time. One method of solving this problem is to articulate the developer units so that only one developer unit at a given time is in operative communication with the latent image. This technique is more fully described in U.S. Pat. No. 3,854,449 issued to Davidson in 1974. Other references, i.e. U.S. Pat. Nos. 3,570,453, 3,575,139 and 3,641,969 teach the articulation of a blade into contact with the developer roll to prevent developer mix from being moved into the development zone. However, no prior art appears to teach the concept of a fixed mounting multi-color development system wherein the developer roll applies toner particles to the latent image and acts as a clean-up magnet to remove residual or unwanted carrier granules therefrom.

Accordingly, it is the primary object of the present invention to improve the development system of an electrostatographic printing machine.

SUMMARY OF THE INVENTION

Briefly stated, and in accordance with the present invention, there is provided an apparatus for forming powder patterns on a surface.

This is achieved, in the present instance, by means, operable for a variable selectable duration of time, for advancing particles. In response to the advancing means being actuated, means, in a particle receiving relationship therewith, apply particles to at least a portion of the surface. Furthermore, other extraneous particles are removed from the surface in response to the advancing means being de-actuated.

BRIEF DESCRIPTION OF THE DRAWINGS

Other objects and advantages of the present invention will become apparent upon reading the following detailed description and upon reference to the drawings, in which.

While the present invention will hereinafter be described in connection with the preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
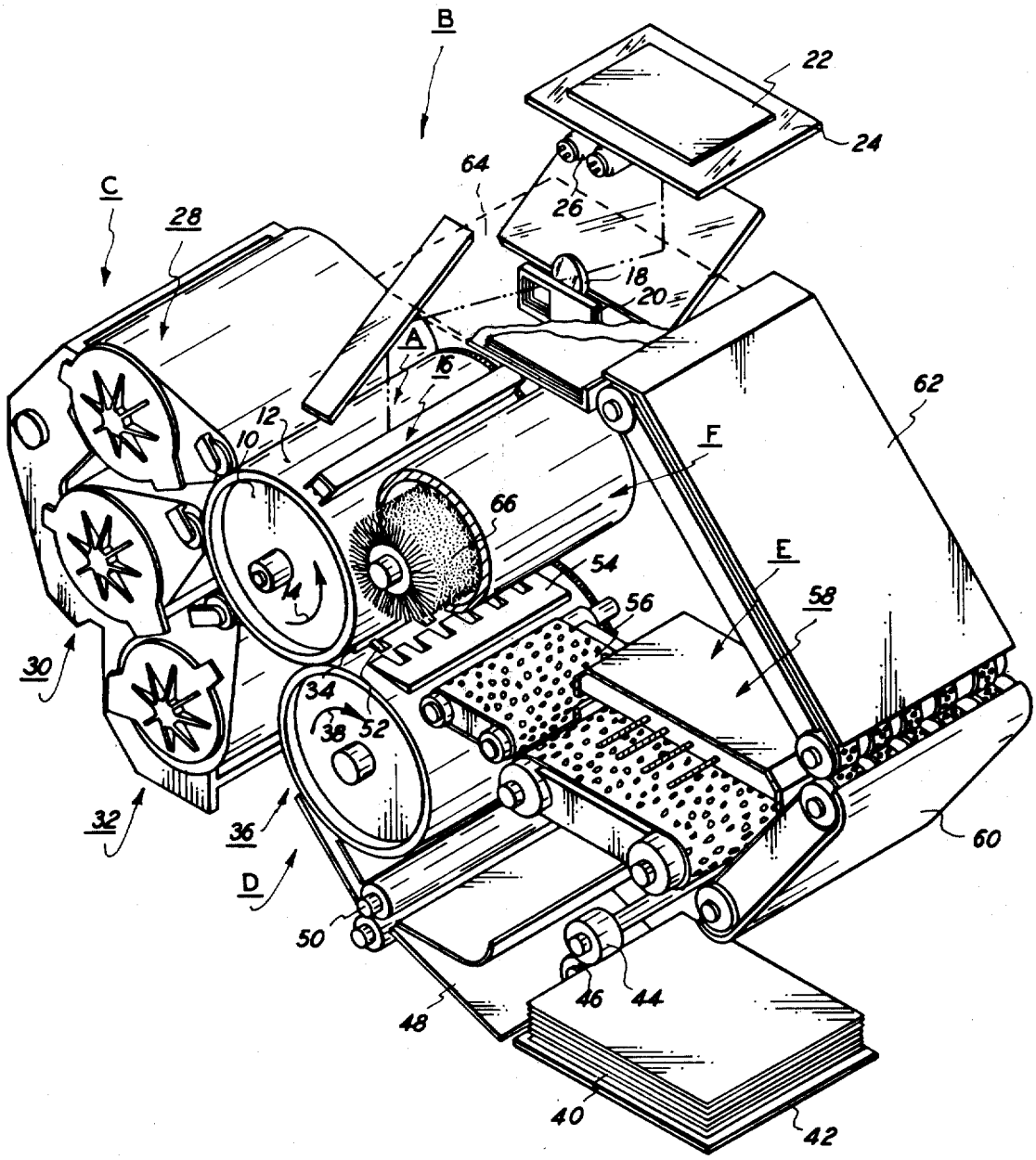
FIG. 1 is a schematic perspective view of an electrophotographic printing machine embodying the features of the present invention therein.

A general understanding of the electrophotographic printing machine, in which the features of the present invention may be incorporated, may be had by referring to the drawings, wherein like reference numerals have been used throughout to designate like elements. FIG. 1 illustrates the various components of a multi-color electrophotographic printing machine. As in all printing machines of the type illustrated, a light image of an original document is projected onto a sensitized photoconductive surface forming an electrostatic latent image thereon. The latent image is developed with toner particles forming a toner powder image. The powder image is subsequently transferred to a sheet of support material and then permanently affixed thereto.

With continued reference to FIG. 1, the printing machine utilizes a photoconductive member comprising a drum 10 having a photoconductive surface 12 entrained thereabout. Photoconductive surface 12, preferably, is formed from a material having a relatively panchromatic response to white light. A suitable type of photoconductive material is described in U.S. Pat. No. 3,655,377 issued to Sechak in 1972. Drum 10 rotates in the direction of arrow 14 to move photoconductive surface 12 sequentially through a series of processing stations.

Initially, photoconductive surface 12 passes through charging station A which has positioned thereat a corona generating device, indicated generally at 16. Corona generating device 16 charges at least a portion of photoconductive surface 12 to a relatively high, substantially uniform potential. A suitable corona generating device is described in U.S. Pat. No. 3,875,407 issued to Hayne in 1975.

The charged portion of photoconductive surface 12 is next rotated to exposure station B. At exposure station B, a moving lens system, generally designated by the reference numeral 18, and a color filter mechanism, shown generally at 20, cooperate with one another to form a single color light image. A suitable lens system is described in U.S. Pat. No. 3,592,531 issued to McCrobie in 1971. U.S. Pat. No. 3,775,006 discloses a suitable filter mechanism. The single color light image irradiates the charged portion of photoconductive surface 12. This single color light image is formed from an original document 22 supported stationarily upon transparent viewing platen 24. This permits successive incremental areas of original document 22 to be illuminated by a moving lamp assembly 26. Lens system 18 is adapted to scan successive incremental areas of original document 22. The light rays reflected from original document 22 pass through lens 18 and filter mechanism 20. Lamp assembly 26, lens system 18 and filter mechanism 20 move in a timed relationship with photoconductive surface 12 to produce a non-distorted flowing light image of the original document. Filter mechanism 20 interposes selected color filters into the optical light path of lens 18. The color filters operate on the light rays passing through lens 18 to record an electrostatic latent image on photoconductive surface 12 corresponding to a specific color of the flowing light image contained within the original document.

After the electrostatic latent image is recorded on photoconductive surface 12, drum 10 rotates to development station C. Development station C includes three developer units generally designated by the reference numerals 28, 30 and 32, respectively. The developer units are of a type generally designated as magnetic brush systems. In a magnetic brush development system, a magnetizable developer mix of carrier granules and toner particles is continually brought through a directional flux field to form a brush of developer material. The developer mix is continually moving to provide fresh developer mix to the brush. Preferably, the brush, in the magnetic brush system, comprises a magnetic member with a mass of developer mix adhering thereto by magnetic attraction. The developer mix includes magnetic carrier granules having non-magnetic toner particles clinging thereto by triboelectric attraction. This chain-like arrangement of developer mix simulates the fibers of a brush. Development is achieved by having the developer mix brush contact the electrostatic latent image recorded on photoconductive surface 12. Each of the developer units 28, 30 and 32, respectively, apply toner particles to the electrostatic latent image which are adapted to absorb light within a pre-selected spectral region of the electromagnetic wave spectrum corresponding to the wave length of light transmitted through the filter. For example, a latent image formed by passing the light image through a green filter will record the red and blue portions of the spectrum as areas of relatively high charge density on photoconductive surface 12, while the green light rays will pass through the filter and cause the charge density on photoconductive surface 12 to be reduced to a voltage level ineffective for development. The charged areas are then made visible by applying green absorbing (magenta) toner particles to the latent image. Similarly, a blue separation is developed with blue absorbing (yellow) toner particles, while a red separation is developed with red absorbing (cyan) toner particles. The detailed structural configuration of developer units 28, 30 and 32, respectively, will be discussed hereinafter in greater detail with reference to FIGS. 2 and 3.

After development, the now visible image is moved to transfer section D. At transfer station D, the toner powder image is transferred to a sheet of support material 34, such as plain paper, amongst others, by means of a electrically biased transfer roll, shown generally at 36. Transfer roll 36 secures releasably thereto a single sheet of support material 34 for movement in a recirculating path therewith, i.e. in the direction of arrow 38. The surface of transfer roll 36 is electrically biased to a potential having a magnitude and polarity sufficient to electrostatically attract toner particles from photoconductive surface 12 to support material 34. Transfer roll 36 rotates in synchronism with drum 10 permitting successive toner powder images to be transferred from photoconductive surface 12 to support material 34 in superimposed registration with one another.

Referring briefly to the sheet feeding path, a stack 40 of support material 34 is disposed on tray 42. The uppermost sheet is advanced by feed roll 44 cooperating with retard roll 46 into chute 48. Chute 48 guides the advancing sheet into the nip between register rolls 50. Register rolls 50 forward the sheet to gripper fingers 52 on transfer roll 36. After a plurality of toner powder images have been transferred to support material 34, gripper fingers 52 space support material 34 from transfer roll 36. As transfer roll 36 continues to rotate, stripper bar 54 is interposed between support material 34 and transfer roll 36. The sheet of support material 34 passes over stripper bar 54 onto conveyor 56. Conveyor 56 moves support material 34 to fixing station E.

At fixing station E, a fuser, indicated generally by the reference numeral 58, permanently affixes the toner powder image to the sheet of support material. A suitable fuser is described in U.S. Pat. No. 3,907,492 issued to Draugelis et al. in 1975. Thereafter, sheet 34 is advanced by endless belt conveyors 60 and 62 to catch tray 64. At catch tray 64, the operator may remove the finished multi-color copy from the printing machine.

The last processing station in the direction of rotation of drum 10, as indicated by arrow 14, is cleaning station F. At cleaning station F, rotatably mounted fibrous brush 66 contacts photoconductive surface 12. In this way, residual toner particles remaining thereon after transfer are removed therefrom.

Figure 2:
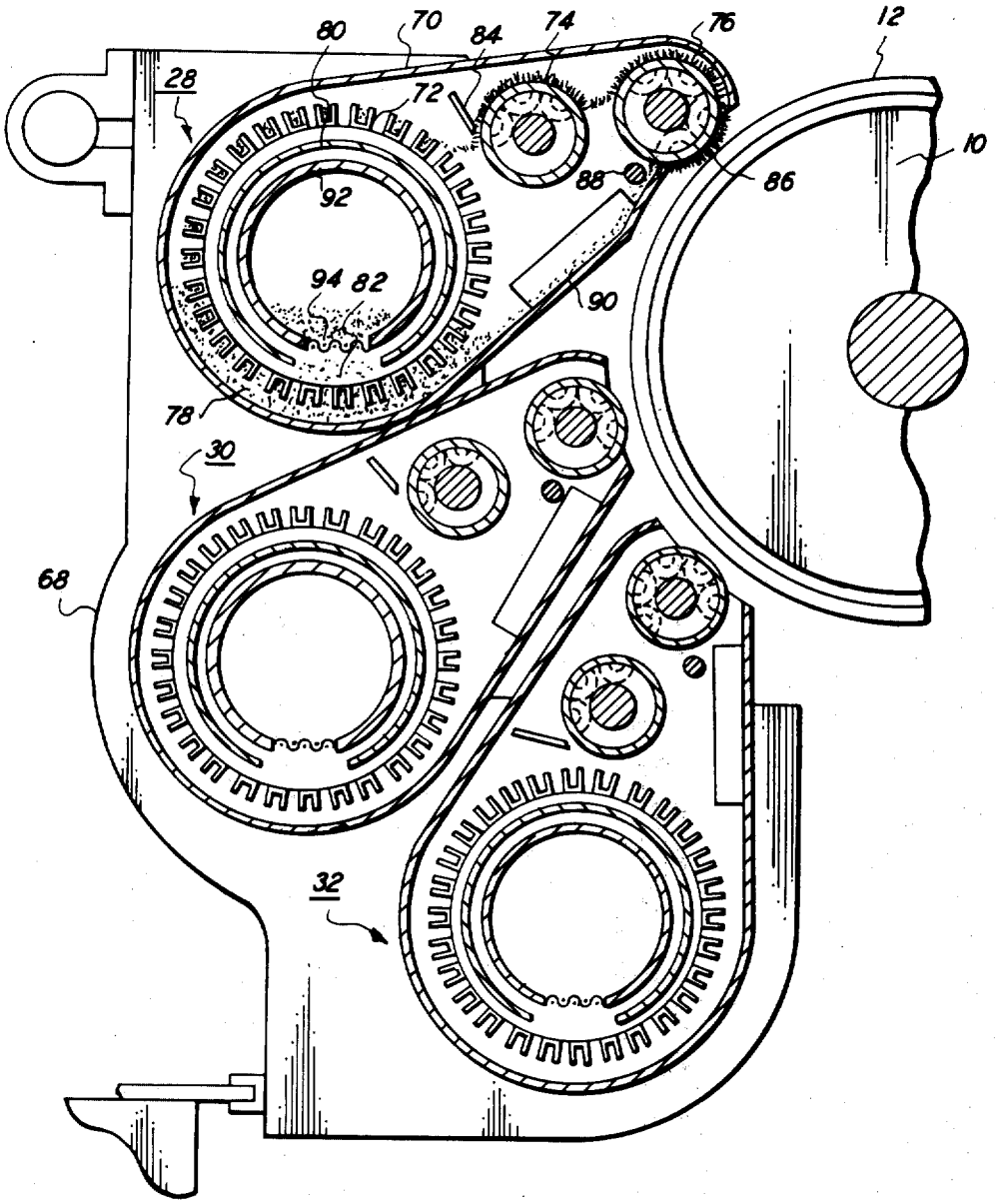
FIG. 2 is a sectional elevational view of the development system of the present invention employed in the FIG. 1 printing machine.

It is believed that the general features of an electrophotographic printing machine incorporating the present invention therein has been amply described by the foregoing. Referring now to the specific subject matter of the present invention, FIG. 2 depicts the development system employed in the FIG. 1 printing machine in greater detail. Turning now to FIG. 2, there is shown a multi-color development system with a frame 68 supporting three developer units 28, 30 and 32, respectively. Each developer unit is depicted as an elevational sectional view to indicate more clearly the various components contained therein. Only developer unit 28 will be described in detail, inasmuch as developer units 30 and 32 are substantially identical thereto, the distinction being that each developer unit has different color toner particles and minor geometrical differences due to the mounting angle.

The principal components of developer unit 28 are developer housing 70, paddle wheel 72, transport roll 74, and developer roll 76. Developer housing 70 is mounted fixedly on frame 68. In this manner, the axis of developer roll 76 is positioned fixedly relative to drum 10 so as to optimize the spacing therebetween. Paddle wheel 72 is a cylindrical member with buckets or scoops located around the periphery thereof. As paddle wheel 72 rotates, developer mix 78 is elevated from the lower region of housing 70 to the upper region thereof. When developer mix 78 reaches the upper region of housing 70, it is lifted from the paddle wheel buckets to transport roll 74. Alternate buckets of the paddle wheel have apertures in the root diameter so that the developer mix carried in these areas falls back to the lower region of developer housing 70. As the developer mix falls back to the lower region of housing 70, it cascades over shroud 80 which is of a tubular configuration with an aperture 82 in the lower region thereof. In this manner, developer mix 78 is recirculated so that the carrier granules are continually agitated to mix with fresh toner particles. This generates a strong triboelectric charge between the carrier granules and toner particles. As developer mix 78, in the paddle wheel buckets, approaches transport roll 74, the magnetic fields produced by the fixed magnets therein attract developer mix 78 thereto. Transport roll 74 moves developer mix 78 in an upwardly direction by the frictional force exerted between the roll surface and developer mix. A surplus of developer mix 78 is furnished, and metering blade 84 controls the amount of developer mix 78 carried over the top of transport roll 74. Surplus developer mix is sheared from transport roll 74 and falls in a downwardly direction toward paddle wheel 72 into the lower region of developer housing 70.

The developer mix which passes metering blade 84 is carried over transport roll 74 to developer roll 76 and into development zone 86 located between photoconductive surface 12 and developer roll 76. The latent image recorded on photoconductive surface 12 is developed by contacting the moving developer mix. At the exit of development zone 86, the strong magnetic fields in a direction generally tangential to developer roll 76 continue to secure thereto the unused developer mix and denuded carrier granules. Upon passing from development zone 86, the unused developer mix and denuded carrier granules enter a region relatively free from magnetic forces and fall from developer roll 76 in a downwardly direction into the lower region of housing 70. Any residual developer mix secured to developer roll 76 is removed therefrom by electromagnet 88. Electromagnet 88 is a bar having coils entrained thereabout; energization thereof produces a magnetic field to attract the residual developer mix and denuded carrier granules thereto. Electromagnet 88 is actuated after the developer cycle rather than during the development cycle. Hence, as the unused developer mix and denuded carrier granules descend, they pass through mixing baffle 90 which diverts the flow from the ends toward the center of developer housing 70 to provide mixing in this direction.

When the complete latent image recorded on photoconductive surface 12 has passed development zone 86, development is discontinued and the developer mix removed from contact with photoconductive drum 10 so that it will not effect subsequent images which are to be developed with different colors. To achieve this, paddle wheel 72 and transport roll 74 are de-actuated. In this way, developer roll 76 is starved for developer mix, i.e. no additional developer mix is furnished thereto. Thus, developer roll 76 becomes devoid of developer mix. Additionally, as developer roll 76 continues to rotate after paddle wheel 72 and transport roll 74 have been de-actuated, it removes extraneous carrier granules on photoconductive surface 12; i.e. it acts as a scavenging roll. Thus, after development, initially paddle wheel 72 and transport roll 74 are de-actuated with developer roll 76 continuing to operate. Developer roll 76 becomes denuded of developer mix and acts as a scavenging roll for a period of time. After a suitable period of time has elapsed, developer roll 76 is also deactuated. At this time, the next successive development unit is actuated to undergo the foregoing cycle for a different color.

Cylindrical shroud 80 serves to control the fall of the unused developer mix and denuded carrier granules such that they mix with the toner particles rather than simply falling into the lower region of housing 70. Furthermore, shroud 80 isolates, from the developer mix, an interior cylindrical enslosure which is used to house cylindrical toner cartridge 92. Toner cartridge 92 contains a fresh supply of toner particles 94 which is dispensed therefrom and passes through aperture 82 in shroud 80 into the stream of developer mix 78. Adding toner particles at this location insures that it cannot be carried into development zone 86 without some degree of mixing with the carrier granules. Additional toner particles are added to the developer mix in order to replace those used in forming the powder image. This maintains the concentration of toner particles within the developer mix substantially constant, thereby providing uniform color image developability.

Figure 3:
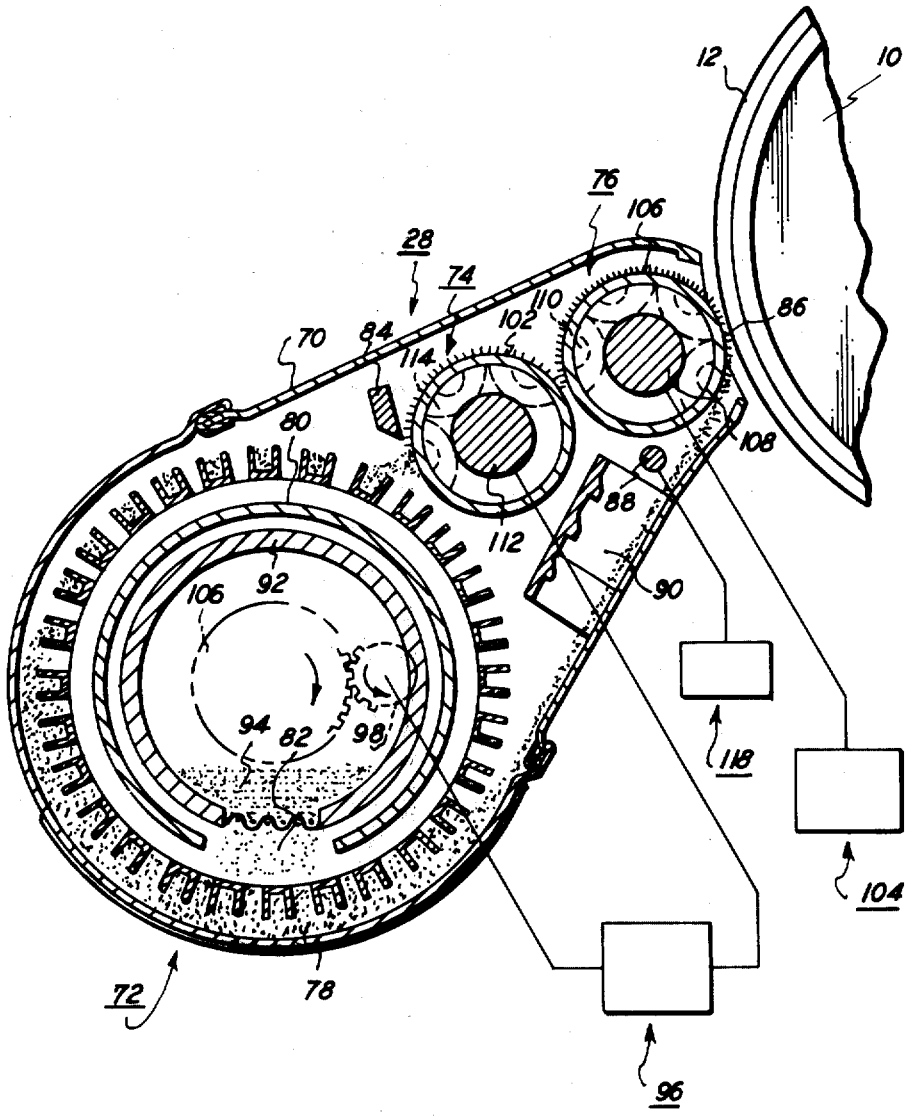
FIG. 3 is a fragmentary sectional elevational view depicting, in detail, one of the development units shown in the FIG. 2 development system.

Referring now to FIG. 3, the detailed structural elements of developer unit 28 will be further discussed. Developer housing 70 is mounted stationarily within frame 68 (FIG. 2). When developer unit 28 is inoperative, paddle wheel 72 and transport roll 74 are stationary and do not advance developer mix 78 to developer roll 76. Operation begins when drive motor 96 is energized. Drive motor 96 rotates clutch gear 98 which meshes with gear 100 attached to paddle wheel 72. Gear 100 also drives a gear train which rotates non-magnetic tube 102 of transport roll 74. In this way, energization of motor 96 rotates paddle wheel 72 and tube 102 of transport roll 74. Developer mix 78 is thereupon advanced by paddle wheel 72 from the lower region of housing 70 to the upper region thereat. At the upper region, developer mix 78 is magnetically attracted to tube 102 of transport roll 74. Motor 104 is energized substantially simultaneously with motor 96. Motor 104 drives a gear train which rotates tube 106 of developer roll 76. One skilled in the art will appreciate that while two motors have been illustrated herein, one main drive motor may be employed in lieu thereof with electromagnetic clutching to each gear train. Thus, tube 106, tube 102, and paddle wheel 72 all start to rotate in synchronism with one another, i.e. at the same time. In this manner, the developer mix brought to roll 102 is magnetically attracted to roll 106 which advances it into development zone 86 for subsequent contact with the electrostatic latent image recorded on photoconductive surface 12 of drum 10. When the complete latent image recorded on photoconductive surface 12 of drum 10 has passed development zone 86, the development action is discontinued. This is achieved by de-energizing motor 96. Thus, paddle wheel 72 and tube 102 cease to rotate. In this way, additional developer mix is no longer furnished to tube 106. This results in no further development action. However, tube 106 continues to rotate as long as motor 104 remains energized. Hence, extraneous carrier granules adhering to photoconductive surface 12 are attracted to tube 106 so as to be removed therefrom improving image quality. Thus, tube 106 acts as a scavenging roll removing extraneous carrier granules from photoconductive surface 12. When tube 102 and paddle wheel 72 are de-energized, electromagnet 88 is energized. As tube 106 continues to rotate, the extraneous carrier granules and unused developer mix adhering thereto are removed therefrom by electromagnet 88 which is energized by power supply 118. Thereafter, upon de-energization of power supply 118, the unused developer mix and extraneous carrier granules fall therefrom in a downwardly direction into the lower region of housing 70 so as to mix with the other developer mix contained therein. After developer unit 28 ceases to apply developer mix to the latent image, the subsequent or remaining developer units are sequentially actuated in the same manner to develop successive electrostatic latent images recorded on photoconductive surface 12 with differently colored toner particles. In this way, three successively differently colored electrostatic latent images are developed with toner particles complementary in color thereto. The toner particles are transferred to the sheet of support material, in superimposed registration with one another, forming a multi-layered copy. This multi-layered copy then passes through the fusing device to permanently affix the toner powder images to the sheet of support material. This results in a colored copy with colors corresponding to the colors of the original document.

Developer roll 76 includes a non-magnetic tube 106, preferably made from aluminum and having an irregular or roughened exterior surface. Tube 106 is journaled for rotation by suitable means such as ball bearing mounts. A shaft 108, made preferably of steel, is concentrically mounted within tube 106 and serves as a fixed mounting for magnetic means 110. Magnetic means 110 preferably, comprises magnets made of barium ferrite in the form of annular rings arranged with five poles on about a 284° arc about shaft 108.

Similarly, transport roll 74 includes a non-magnetic tube 102, preferably, made from aluminum having an irregular or roughened exterior surface. Tube 102 is journaled for rotation by suitable means such as ball bearing mounts. A shaft 112 made, preferably, of steel is concentrically mounted within tube 102 and functions as a fixed mounting for magnetic means 114. Magnetic means 114, preferably, includes barium ferrite magnets in the form of annular rings arranged with four poles on about a 180° arc about shaft 112.

Motors 96 and 104 are controlled by a timing disc mounted to an extension of drum shaft 116 (FIG. 1). The timing disc is opaque with a plurality of spaced slots in the circumferential periphery thereof. The disc is interposed between a light source and a photosensor to generate an electrical signal as each slot permits light rays to pass through the disc. The electrical signal, in association with suitable machine logic, actuates motors 96, and 104 at substantially the same time. As drum 10 continues to rotate, the disc rotates therewith. After the drum has rotated through a suitable arc, the latent image is no longer in development zone 86. At this time, the slits on the periphery of the timing disc, in association with the machine logic, develop an electrical signal which de-energizes motor 96. In this way, transport roll 74 and paddle wheel 72 are inactivated and no longer advance the developer mix to developer roll 76. Substantially simultaneously therewith, power supply 118 is coupled to electromagnet 88. This energizes electromagnet 88. Thus, motor 104 continues to remain energized thereby allowing developer roll 76 to remove the extraneous carrier granules adhering to photoconductive surface 12. After a suitable period of time, as indicated by a continued rotation of drum 10, the electrical signal from the timing disc de-energizes motor 104 and de-couples power supply 118 from electromagnet 88. At this time, the next successive developer unit is activated as heretofore described.

In recapitulation, it is apparent that the development system of the present invention improves multi-color copies produced in an electrophotographic printing machine by maintaining each of the development systems stationary and at a fixed position relative to the photoconductive surface. Successive developer units are actuated and serve both to apply the developer mix and to remove extraneous carrier granules from the photoconductive surface. In this manner, the extraneous carrier granules are prevented from being transferred to the sheet of support material. Thus, the development system heretofore described is an improvement over those hereinbefore employed.

It is, therefore, evident that there has been provided in accordance with the present invention, an apparatus for developing an electrostatic latent image that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and scope of the appended claims.

What is claimed is:

1. An apparatus for forming a powder pattern on a surface, including:

means, operable for a variably selectable duration of time, for advancing particles;

means, in a particle receiving relationship with said advancing means, for applying particles to at least a portion of the surface, in response to said advancing means being operable, and for removing other extraneous particles from the surface, in response to said advancing means being inoperable, said applying means being a fixed distance from the surface; and electromagnetic means operatively associated with said applying and removing means to remove particles therefrom, said electromagnetic means being operable in response to said advancing means being inoperable.

2. An apparatus as recited in claim 1, further including a housing defining a chamber for storing a supply of particles therein.

3. An apparatus as recited in claim 2, wherein said advancing means includes:

conveyor means mounted for movement within the chamber of said housing to move the particles from a first region to an intermediate region; and rotary driven transport means mounted within the chamber of said housing to move the particles from the intermediate region to a second region for discharge thereat.

4. An apparatus as recited in claim 3, wherein said advancing means includes means for actuating said conveyor means and said transport means for a variably selectable duration of time.

5. An apparatus as recited in claim 4, wherein said applying and removing means includes rotary driven developer means mounted within the chamber of said housing closely proximate to said transport means for receiving the particles therefrom during the actuation of said conveyor means and said transport means to deposit particles onto the surface forming a powder pattern thereon, said developer means being arranged to attract other extraneous particles from the surface thereto during the de-actuation of said conveyor means and said transport means.

6. An apparatus as recited in claim 5, wherein said applying and removing means includes means for actuating said developer means, in response to said conveyor means and said transport means being actuated, and for de-actuating said developer means a variably selectable duration of time after the de-actuation of said conveyor means and said transport means.

7. An apparatus as recited in claim 6, wherein:

said transport means includes a first tubular member of non-magnetic material, and first magnetic means mounted fixedly interiorly of said first tubular member for generating a magnetic field in the path of the periphery of said first tubular member; and said developer means includes a second tubular member of non-magnetic material, and second magnetic means mounted fixedly interiorly of said second tubular member for creating a magnetic field in the path of the periphery of said second tubular member.

8. An improved electrophotographic printing machine of the type having a photoconductive member, a corona generating device for charging at least a portion of the photoconductive member to a substantially uniform level, and an exposure mechanism for exposing the charged portion of the photoconductive member to a light image of an original document being reproduced to record thereon an electrostatic latent image thereof, wherein the improvement includes:

means, operable for a variable selectable duration of time, for advancing particles;

means, in a particle receiving relationship with said advancing means, for applying particles to the electrostatic latent image recorded on the photoconductive member, in response to said advancing means being operable, and for removing other extraneous particles from the photoconductive member in response to said advancing means being inoperable, said applying means being a fixed distance from the photoconductive member; and electromagnetic means operatively associated with said applying and removing means to remove particles therefrom, said electromagnetic means being operable in response to said advancing means being inoperable.

9. A printing machine as recited in claim 8, further including a developer housing defining a chamber for storing a supply of particles therein.

10. A printing machine as recited in claim 9, wherein said advancing means includes:

conveyor means mounted for movement within the chamber of said developer housing to move the particles from a first region to an intermediate region; and rotary driven transport means mounted within the chamber of said developer housing to move the particles from the intermediate region to a second region for discharge thereat.

11. A printing machine as recited in claim 10, wherein said advancing means includes means for actuating said conveyor means and said transport means.

12. A printing machine as recited in claim 11, wherein said applying and removing means includes rotary driven developer means mounted within the chamber of said developer housing closely proximate to said transport means for receiving the particles therefrom during the actuation of said conveyor means and said transport means to deposit particles onto the electrostatic latent image recorded on the photoconductive member, said developer means being arranged to attract other extraneous particles from the photoconductive member thereto during the de-actuation of said conveyor means and said transport means.

13. A printing machine as recited in claim 12, wherein said applying and removing means includes means for actuating said developer means, in response to said conveyor means and said transport means being actuated, and for de-actuating said developer means a variably selectable duration of time after the de-actuation of said conveyor means and said transport means.

14. A printing machine as recited in claim 13, wherein:

said transport means includes a first tubular member of non-magnetic material, and first magnetic means mounted fixedly interiorly of said first tubular member for creating a magnetic field in the path of the periphery of said tubular member; and said developer means includes a second tubular member of non-magnetic material, and second magnetic means mounted fixedly interiorly of said second tubular member for creating a magnetic field in the path of the periphery of said second tubular member.

* * * * *